US007736448B2

(12) United States Patent
Lu et al.

(10) Patent No.: US 7,736,448 B2
(45) Date of Patent: Jun. 15, 2010

(54) NANO ICRYSTALS COPPER MATERIAL WITH SUPER HIGH STRENGTH AND CONDUCTIVITY AND METHOD OF PREPARING THEREOF

(75) Inventors: Lei Lu, Liaoning (CN); Xiao Si, Liaoning (CN); Yongfeng Shen, Liaoning (CN); Ke Lu, Liaoning (CN)

(73) Assignee: Institute of Metal Research Chinese Academy of Sciences, Shenyang (CN)

( * ) Notice: Subject to any disclaimer, the term of this patent is extended or adjusted under 35 U.S.C. 154(b) by 1385 days.

(21) Appl. No.: 10/532,674

(22) PCT Filed: Oct. 16, 2003

(86) PCT No.: PCT/CN03/00867

§ 371 (c)(1),
(2), (4) Date: Apr. 26, 2005

(87) PCT Pub. No.: WO2004/040042

PCT Pub. Date: May 13, 2004

(65) Prior Publication Data

US 2006/0021878 A1 Feb. 2, 2006

(30) Foreign Application Priority Data

Nov. 1, 2002 (CN) ..... 02 1 44519

(51) Int. Cl.
*C22C 1/00* (2006.01)
*C25D 1/04* (2006.01)

(52) U.S. Cl. ..... 148/432; 148/433; 148/434; 148/435; 148/436; 420/469; 420/470; 420/471; 420/472; 420/473; 420/474; 420/475; 420/476; 420/477; 420/478; 420/479; 420/480; 420/481; 420/482; 420/483; 420/484; 420/485; 420/486; 420/487; 420/488; 420/489; 420/490; 420/491; 420/492; 420/493; 420/494; 420/495; 420/496; 420/497; 420/498; 420/499; 420/500

(58) Field of Classification Search ..... 148/432–436; 420/469–500

See application file for complete search history.

(56) References Cited

U.S. PATENT DOCUMENTS

| | | | |
|---|---|---|---|
| 5,431,803 | A | 7/1995 | DiFranco et al. |
| 2002/0015833 | A1 | 2/2002 | Takahashi et al. |

FOREIGN PATENT DOCUMENTS

| | | | |
|---|---|---|---|
| CN | 1 105 398 | | 7/1995 |
| CN | 1105398 | A | 7/1995 |
| CN | 1 337 475 | | 2/2002 |
| CN | 1337475 | A | 2/2002 |
| CN | 1389597 | A | 1/2003 |
| CN | 1181224 | C | 12/2004 |

OTHER PUBLICATIONS

Lyttle, Mark T.;Hughes, D.A., Nano0Lamellar Structures in a Rolled Cu-Ag Alloy, Materials Research Society Symposium Proceedings (2001), 683 E(Material Instabilities and Patterning in Metals), No pp. given, Paper #:BBI.4 CODEN: MRSPDH; ISSN: 0272-9172.*

P.G. Sanders, et al., "Elastic and Tensile Behavior of Nanocrystalline Copper and Palladium", Acta Mater, vol. 45, No. 10, pp. 4019-4025 (1997).

R. Suryanarayanan, et al., "mechanical Properties of Nanocrystalline Copper Produced by Solution-Phase Synthesis", Journal of Materials research, vol. 11, No. 2, Feb. 1996, pp. 439-448.

M. Legros, et al., "Microsample Tensile Testing of Nanocrystalline Metals", Philosophical Magazine A, 2000, vol. 80, No. 4, pp. 1017-1026.

Y.M. Wang, et al., "Microsample Tensile Testing of Nanocrystalline Copper", Scripta Mater, 48 (2003) pp. 1581-1586.
R.K. Islamgaliev et al., "The Determination of the Grain Boundary Width of Ultrafine Grained Copper and Nickel from Electrical Resistivity Measurements", Phys. Stat. Sol. (a), 162, pp. 559-566 (1997).
Notification Concerning Submission or Transmittal of Priority Document (Form PCT/IB/304) issued in connection with PCT/CN03/00867.
Abstract for CN 1389597 having a publication date of Jan. 8, 2003 for invention entitled "High-strength and high-conductivity nanometer crystal copper material and its prepn".

* cited by examiner

*Primary Examiner*—Sikyin Ip
(74) *Attorney, Agent, or Firm*—Smith, Gambrell & Russell, LLP

(57) ABSTRACT

The present invention relates to a nanocrystalline metallic material, particularly to nano-twin copper material with ultra-high strength and high electrical conductivity and its preparation method. High-purity polycrystalline Cu material with a microstructure of roughly equiaxed submicron-sized grains (300-1000 nm) has been produced by pulsed electrodeposition technique, by which high density of growth-in twins with nano-scale twin spacing were induced in the grains. Inside each grain, there are high densities of growth-in twin lamellae. The twin lamellae with the same orientations are inter-parallel, and the twin spacing ranges from several nanometers to 100 nm with a length of 100-500 nm. This Cu material invented has more excellent performance than existing ones. The tensile yield strength and ultimate strength of the present Cu material at room-temperature can be as high as 900 MPa and 1086 MPa, respectively, and such a high tensile strength can not be achieved for the Cu materials with the same chemical composition prepared by any traditional methods. Meanwhile, the present Cu sample also keeps a good electrical conductivity, for example, the room-temperature resistivity is $(1.75\pm0.02)\times10^{-8}$ Ω·m, corresponding to 96% IACS, which is close to that of the conventional coarse-grained Cu.

4 Claims, 4 Drawing Sheets

NANO ICRYSTALS COPPER MATERIAL WITH SUPER HIGH STRENGTH AND CONDUCTIVITY AND METHOD OF PREPARING THEREOF

FIELD OF THE INVENTION

This invention relates to a nanocrystalline metal material, particularly to the nano-twin copper material with ultrahigh strength and high electrical conductivity, and its preparation method.

BACKGROUND OF THE INVENTION

The copper and its alloy are a kind of nonferrous metals that are used comprehensively for many proposes. It was frequently used as early as thousands years ago. For example, in Yin and Zhou dynasty (more than 3700 years ago), Chinese people are well known for the manufacturing on the bells, tripods (ancient cooking vessel with two loop handles and three or four legs) as well as weapons by bronze. So far, Cu and its alloys are still extensively used in conventional and modern industry. The main characteristics of Cu and its alloys are high electrical conductivity, good thermal conductivity, also good corrosion resistance in atmosphere, seawater and many other mediums. Moreover, they have very good plasticity and wear resistance, which are suitable for processing and casting various kinds of products. The copper and its alloys are the indispensable metal materials in many industrial fields, such as electric power, electrician equipment, thermal technology, chemical industry, instrument, shipbuilding and machine-manufacturing, etc.

The pure Cu has a very good conductive performance. However, the strength is pretty low. Strengthening Cu and its alloys could be approached by several methods, such as grain refinement, cold working, solid solution alloying etc, but such approaches usually lead a pronounced decrease in conductivity. For example, alloying pure Cu by adding elements (Al, Fe, Ni, Sn, Cd, Zn, Ag, Sb etc.) may increase the strength by two or three times, but the electrical conductivity of Cu alloys will decrease dramatically. Otherwise, adding minim Fe and Ni will affect the magnetic property of Cu, which is a disadvantage to making compasses and aviation instrument. The volatilities of some alloy elements, such as Cd, Zn, Sn and Pb etc., would limit their application in electronic industry, especially in high temperature and high vacuum environments. Currently, machine equipment, toolmaking and instrument apparatus are going for a high speed, high efficiency, high sensitivity, low energy consumption and microminiaturization. Therefore the high and comprehensive demand for copper material has been presented in precision and reliability. For instance, the new-type high performance of copper material is urgently required in the rapidly developing computer industry, automobile industry, radio communication (such as plug connector in cell phone and lithium battery) and printing (for making the multi-layer printed circuit board and high density printed circuit board) etc. So there are great challenges to significantly strengthening copper and its alloys without damaging their excellent electrical conductivity.

The nanocrystalline materials refer to single phase or multiphase solid materials consisting of very fine grains of 1-100 nm in diameter. Due to its small grain and numerous grain boundaries (GBs), nanocrystalline materials are expected to exhibit tremendous difference from conventional micron-sized polycrystalline materials in physical and chemical performances, such as mechanics, electrics, magnetics, optics, calorifics, chemistry etc.

Grain refinement is often used to strengthen materials in engineering, which increases the strength of materials by introducing more grain boundaries to obstacle dislocation motion, described by the well-known Hall-Petch (H-P) relationship as $\sigma_y=\sigma_0+d^{-1/2}$. However, the strength does not monotonously increase with decreasing grain sizes in any regiem; when the grain size reduces down to nanometer scale, especially less than a critical size, abnormal H-P relationship will occur. Actually, both experimental observations and computer simulations have shown that the strengthening effect will weaker or disappear as the grain sizes are refined to nanometer, thereby softening effect appears. When grain sizes are small enough, namely close to lattice dislocation equilibrium distance, few dislocations can be accommodated in grains, and grain boundary activities (e.g. grain boundary rotating and sliding) would be dominate, leading to the softening of materials. Therefore, for nanocrystalline materials, ultrahigh strength can be achieved by suppressing the dislocation activities and the grain boundary activities simultaneously.

Strengthening of solid solution alloying or introduction of a second phase is also effective method in blocking the motion of lattice dislocations. Cold-working (plastic straining), which generates numerous dislocations during deformation process and limits the further dislocation activities, also strengthen the materials. All of these strengthening approaches are based on the introduction of various kinds of defects (GBs, dislocations, point defects and reinforcing phases, etc.), which restrict dislocation motion but increase the scattering for the conducting electrons. The latter will decrease the electrical conductivity of materials.

For example, the tensile yield strength ($\sigma_y$) of the coarse-grained Cu at room temperature is only 0.035 GPa, which is about two orders of magnitude lower than the theoretical strength, and the elongation is about 60%. After cold-working (as-rolled Cu), the tensile yield strength increases appropriately, being about 250 MPa. Nanocrystalline Cu has higher $\sigma_y$ than coarse-grained Cu. American scientists J. R. Weertman et al. [Sander P. G, Eastman J. A. & Weertman J. R., Elastic and tensile behavior of nanocrystalline copper and palladium, *Acta Mater.*, 45 (1997) 4019-4025] produced nanocrystalline Cu by inert-gas condensation with grain sizes of about 30 nm, and the tensile yield strength is 365 MPa at room temperature. Prof. R. Suryanarayana et al. [Suryanarayana R. et al., Mechanical properties of nanocrystalline copper produced by solution-phase synthesis, *J. Mater. Res.* 11 (1996) 439-448] prepared nanocrystalline copper powder by ball milling, then cold-pressed the purified Cu powder to nanocrystalline Cu with the grain size of 26 nm, it's yield strength is about 400 MPa. However, nanocrystalline samples have very limit elongations, usually less than 1-2%. In China, L. Lu, K. Lu et al. (patent application numbered 0114026.7) produced bulk nanocrystalline Cu with the grain sizes of 30 nm by electrodeposition technique. It is indicated that the as-deposited nanocrystalline Cu consisted of small-angle GBs, unlike the large-angle GBs in conventional nanometer materials. The yield strength at room temperature is 119 MPa and the elongation 30%.

If the as-deposited nanocrystalline Cu was cold-rolled at room temperature, the average grain sizes of the sample remained unchanged, but the misorientation among the nanocrystallites and the dislocation density increased. The yield strength of the as-rolled nanocrystalline Cu reached as high as 425 MPa, but the elongation declined to 1.4%. J. R. Weertman et al. achieved the yield strength of 535 MPa in microsample tensile testing of nanocrystalline Cu specimen (1 mm) [Legros M., Elliott B. R., Ritter M. N., Weertman J. R.

& Hemker K. J., Microsample tensile testing of nanocrystalline metals, *Philos. Mag. A.,* 80 (2000) 1017-1026]. For the nanocrystalline Cu samples produced by surface mechanical attrition treatment, the tensile results at room temperature of the microsamples (thickness of the sample 11-14 μm, gauge length 1.7 mm, cross-section area 0.5 mm×0.015 mm) showed that the yield strength was as high as 760 MPa, but the elongation was almost zero [Wang Y. M., K. Wang, Pan D., Lu K., Hemker K. J. and Ma E., Microsample tensile testing of nanocrystalline Cu, *Scripta Mater.,* 48 (2003) 1581-1586]. Meanwhile, the yield strength of about 400 MPa is achieved in compression testing at room temperature for the copper with the grain size of 109 nm processed by severe plastic deformation, however, the electrical resistivity at room temperature (293 K) was as high as $2.46\times10^{-8}$ Ω·m (only 68% IACS) [Islamgaliev R. K., Pekala K., Pekala M. and Valiev R. Z., *Phys. Stat. Sol.* (*a*), 162 (1997) 559-566].

SUMMARY OF THE INVENTION

It is an object of the present invention to provide nano-twin copper material with ultrahigh strength and high electrical conductivity, and its preparation method. nano-twin copper material with ultrahigh strength and high electrical conductivity, and its preparation method In order to realize the purposes above-mentioned, the technical program of this invention is as follows:

The microstructures of nano-twin Cu with ultrahigh strength and high electrical conductivity are composed of roughly equiaxial submicron-sized grains, in which are twin lamellar structures with random orientations and high density. The twin lamellae with the same orientation are parallel to each other in the grains. The lamellae thicknesses vary from several nanometers to 100 nm, and the length from 100 nm to 500 nm;

In addition, the density of material is 8.93±0.03 g/cm$^3$, purity is 99.997±0.02 at %, yield strength is 900±10 MPa, elongation is 13.5±0.5% at room temperature with a tensile strain rate of $6\times10^{-3}$/s; submicron-sized grain size varies from 300-1000 nm; the electrical resistivity and temperature coefficient of resistivity at room temperature (293 K) are $(1.75\pm0.02)\times10^{-8}$ Ω·m and $6.78\times10^{-11}$ K$^{-1}$, respectively, corresponding to a conductivity g=96% IACS (IACS stands for international annealed copper standard).

The preparation method of nano-twin Cu with ultrahigh tensile strength and high electrical conductivity is as follows:

Using electrodeposition technique, the electrolyte consists of electron purity grade $CuSO_4$ solution with ion-exchanged water or distilled water, pH 0.5-1.5; anode is 99.99% pure Cu sheet; cathode is Fe or low carbon steel sheets plated with a Ni—P amorphous surface layer.

Detailed electrolysis technique parameters are as follows: pulsed current density is 40-100 A/cm$^2$ with a on-time ($t_{on}$) of 0.01-0.05 s and off-time ($t_{off}$) of 1-3 s, the distance between cathode and anode of 50-150 mm, ratio of anode and cathode areas of (30-50)μl. The electrolyte was controlled with a temperature range from 15-30° C., while be stirred electromagnetically. The additive is composed of 0.02-0.2 mL/L gelatine (5-25%) aqueous solution and 0.2-1.0 mL/L high-purity NaCl (5-25%) aqueous solution.

The present invention has the following advantages:

1. Excellent property. One feature of present invention is that high density of growth-in twins with nano-meter spacing was induced in pure Cu specimens by means of pulsed electrodeposition techniques. The spacing of the twin lamellae varies from several nanometers to 100 nm, and the lengths are about 100-500 nm.

The present material shows the ultrahigh tensile yield strength of 900 MPa at room temperature, which is much higher than that of the Cu samples with comparable grain size produced by conventional method. Meanwhile, the sample keeps a very good conductivity: the electrical conductivity at room-temperature is 96% ICAS.

2. Wide application. Because of the special twin lamellae with a nanometer space, the present Cu shows an ultrahigh strength, while maintaining reasonable electrical conductivity and thermal stability. Therefore, this special material sheds light on the rapidly developing computer industry, radio communication and printing board.
3. Simple preparation method. The Cu specimens with high density growth-in nano-scale twins in the present invention can be achieved by means of the conventional electrodeposition technique by modifying the technological conditions and controlling appropriate deposition parameters.

BRIEF DESCRIPTION OF THE DRAWINGS

FIG. 1-2 is the statistical distributions for grain size measured from TEM image of the as-deposited copper with nano-scale twins by means of pulsed electrodeposition of the present invention.

FIG. 1-3 is the statistical distributions for the thickness of the twin lamellae measured from the TEM images of the as-deposited copper with nano-scale twins by means of pulsed electrodeposition of the present invention.

FIG. 2-1 is the HRTEM image of the as-deposited copper with nano-scale twins by means of pulsed electrodeposition of the present invention.

FIG. 2-2 is the electron diffraction patterns corresponding to HRTEM image of the as-deposited copper with nano-scale twins by means of pulsed electrodeposition of the present invention (here A and T are twinning elements, A is matrix and T is twin,).

FIG. 3 is the typical tensile stress-strain curves for the as-deposited Cu with nano-twins and the coarse-grained polycrystalline Cu sample at room temperature.

DESCRIPTION OF THE INVENTION IN DETAIL

The invention will be further described in detail with reference to drawings attached and examples below.

EXAMPLE 1

1. The Cu materials with high density nano-scale twin lamellae structures were prepared by means of pulsed electrodeposition technique. The electrolyte was the electron purity grade $CuSO_4$ solution with ion-free water, in which the contents of impurities, such as heavy metals, were rigidly controlled. The acidity was pH=1. A pure Cu sheet (purity >99.99%) was used as anode and a Fe sheet with a Ni—P amorphous surface layer was used as the cathode.
2. Electrolysis processing parameters: pulsed current density of 50 A/cm$^2$ with a on-time ($t_{on}$) of 0.02 s and off-time ($t_{off}$) of 2 s, the polar distance of 100 mm; the area ratio of anode to cathode of 50:1, the bath was stirred electromagnetically, the electrodepostion processing was performed at 20° C. The bath additive was composed of 0.1 mL/L gelatine aqueous solution (concentration 15%) and 0.6 mL/L high-purity NaCl aqueous solution (concentration 15%).

The prepared Cu specimens with high density of nano-scale (1 nm=$10^{-9}$ m) twin lamellae show an ultrahigh tensile yield strength of 900±10 MPa and a good electrical resistivity of (1.75±0.02)×$10^{-8}$ Ω·m (corresponding to 96% IACS) at room temperature (only 0.2$T_m$, $T_m$ is melting temperature).

The results of chemical analysis showed that the purity of as-deposited Cu sample is better than 99.998 at %. The chemical content of impurity element is indicated as follows:

| Element | Content (%) | Element | Content (%) |
|---|---|---|---|
| Bi | <0.00003 | Sn | <0.0001 |
| Sb | 0.00005 | Ag | 0.0002 |
| As | 0.0001 | Co | 0.00003 |
| Pb | 0.00005 | Zn | 0.00005 |
| Fe | 0.001 | Ni | 0.00005 |

Figure 1:
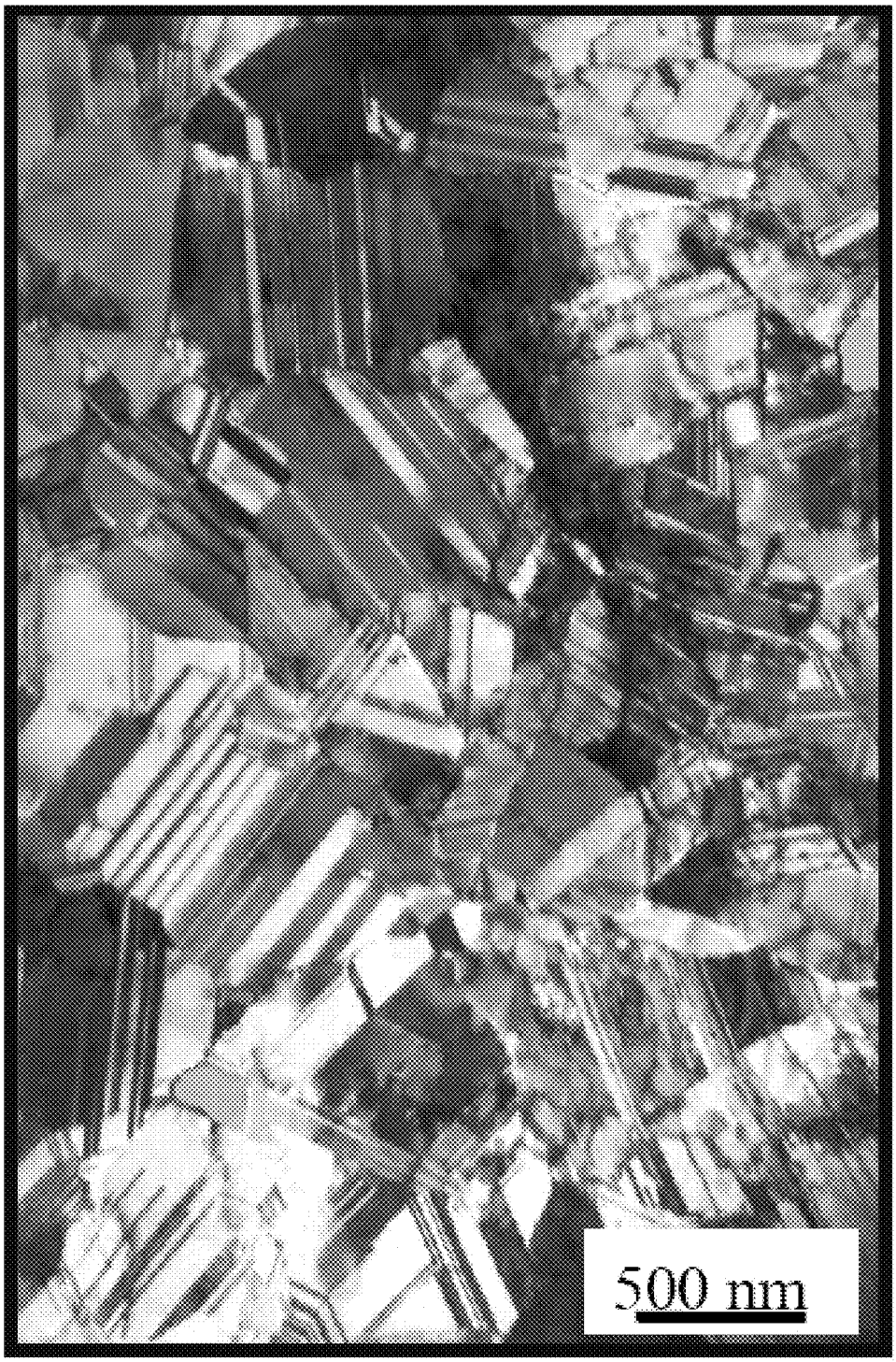
FIG. 1-1 is a bright-field TEM image of the as-deposited copper with nano-scale twins by means of pulsed electrodeposition of the present invention.
Figures 1, 2:
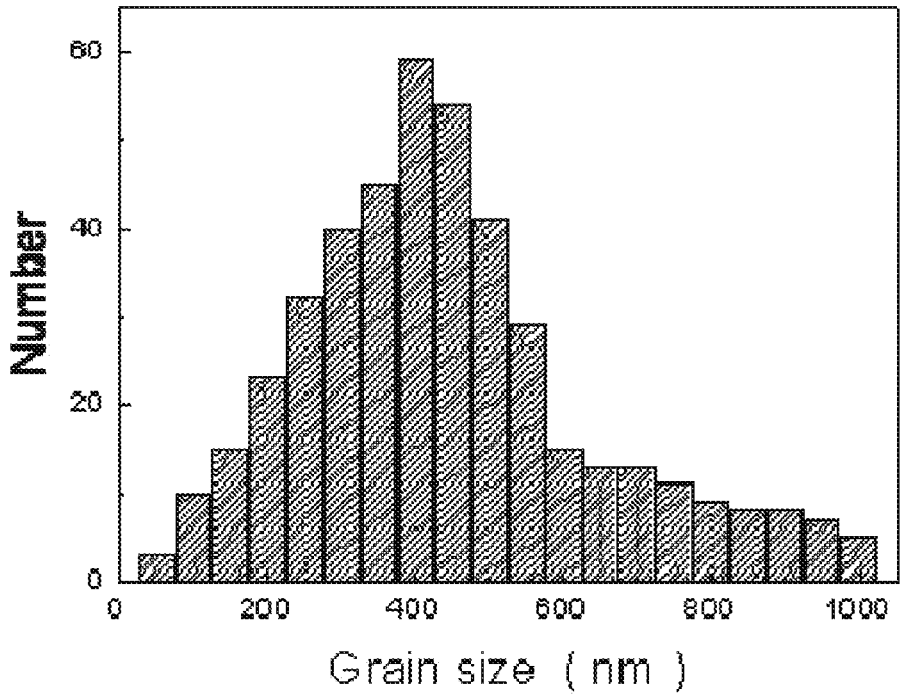
Figures 1, 2, 3:
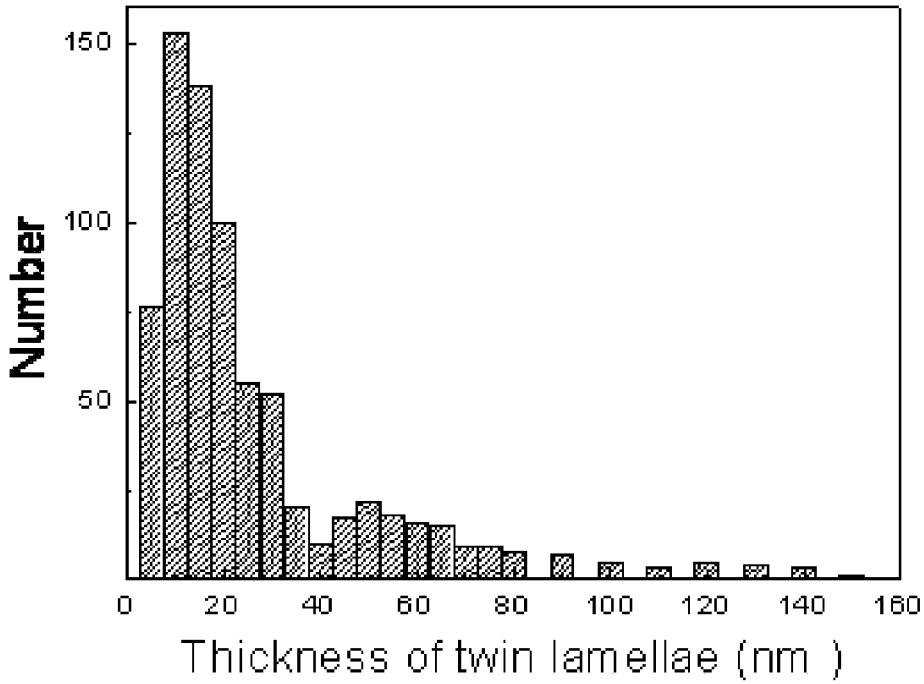
Figures 1, 2:
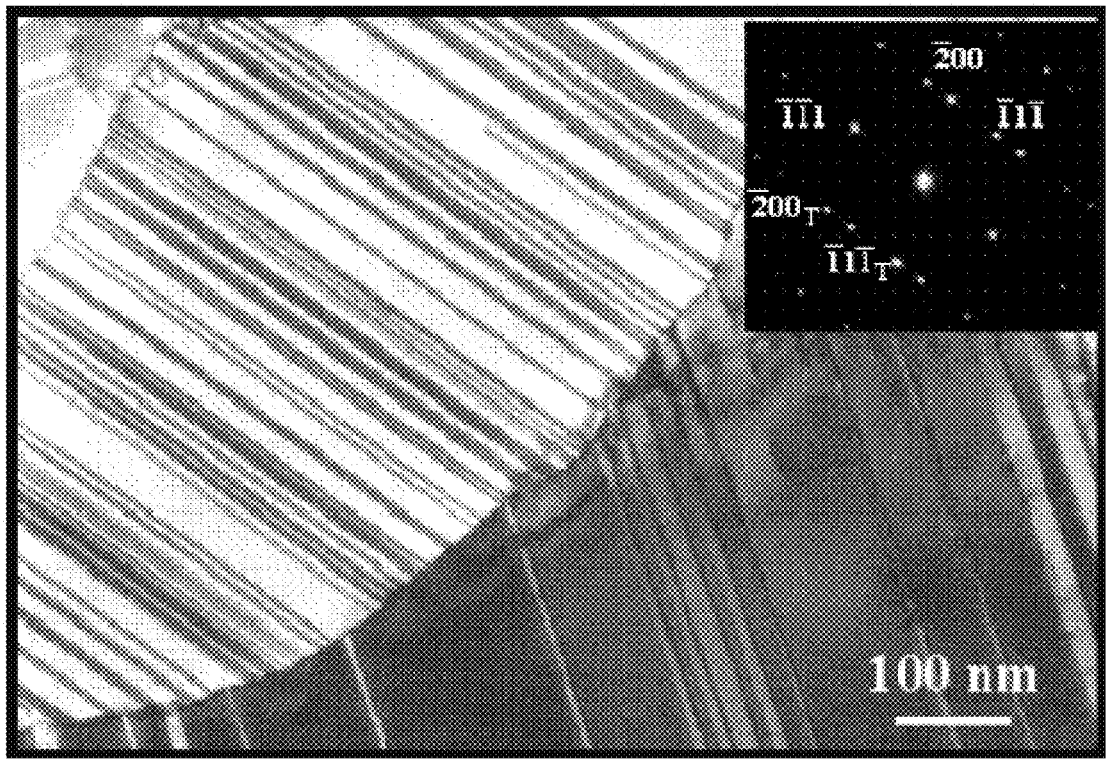
Figure 2:
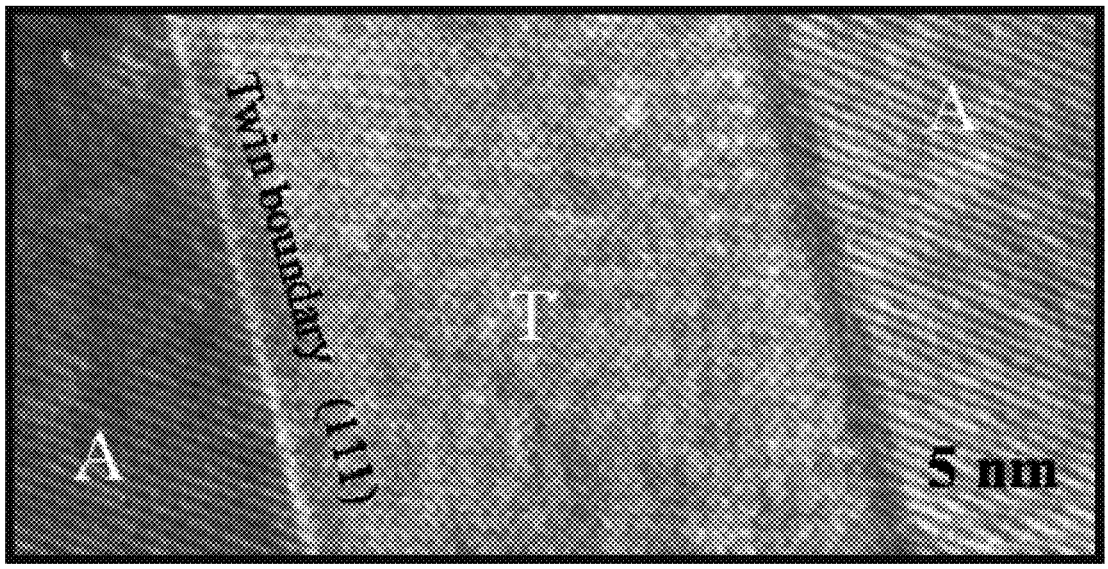
Figure 3:
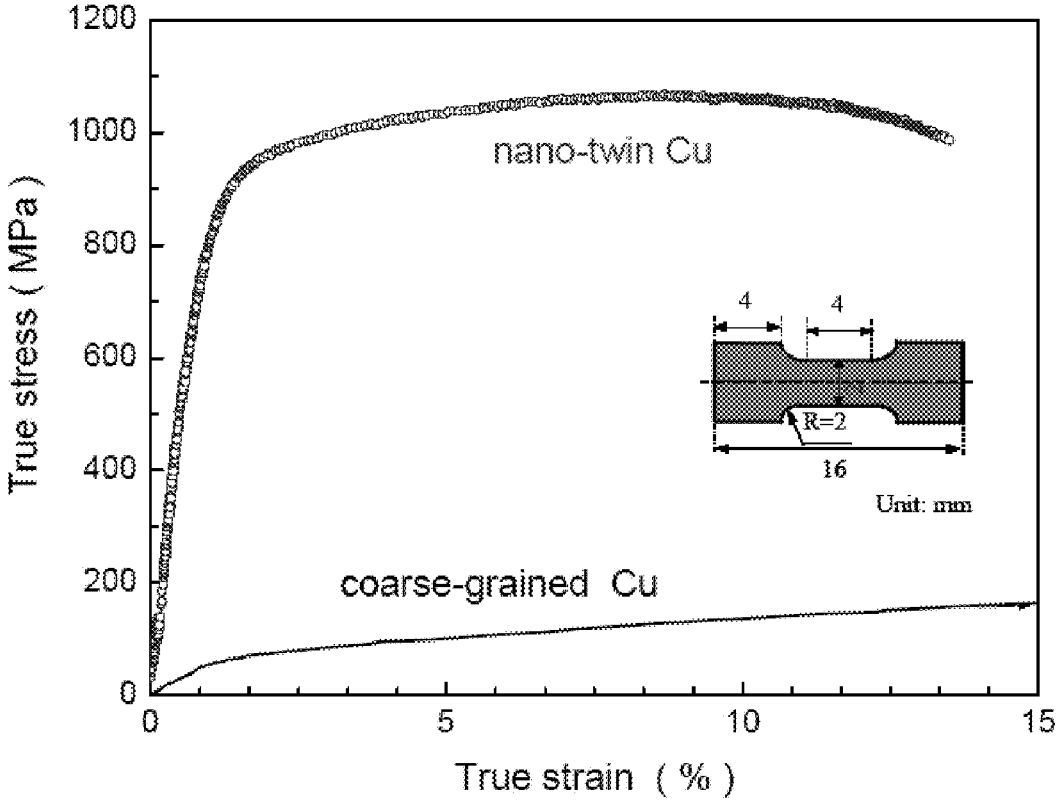

The density of sample measured by Archimedes principle is 8.93±0.03 g/$cm^3$, comparable to 99.7% of the theoretical density (8.96 g/$cm^3$) of polycrystalline pure Cu in the literature. High resolution transmission electron microscopy (HR-TEM) showed that the nanocrystalline Cu consists of roughly equiaxed submicron-sized (300-1000 nm) grains, in which there are high density twin lamellar structures with different orientations, and the twin lamellae are parallel to each other in the grains (FIGS. 1-1, 1-2, 1-3). The lamella thickness varies from about several nanometers to 100 nm, and the average spacing is about 15 nm. The lengths are about 100-500 nm. The dislocation density is very low in the as-deposited sample. Most twin boundaries in the as-deposited Cu samples are coherent twin boundaries; only few dislocations can be detected (FIG. 1-1, 1-2, 1-3, 2-1, 2-2).

Figure 4:
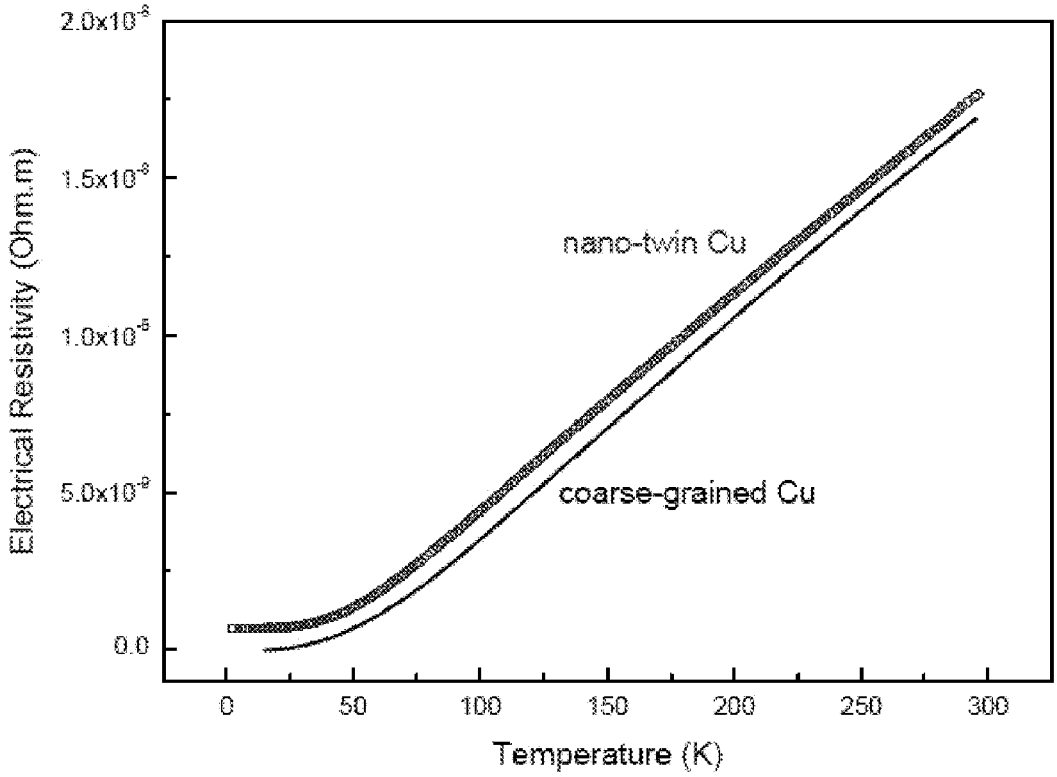
FIG. 4 is the measured temperature dependence of electrical resistivity for the as-deposited Cu with nano-twins and the coarse-grained polycrystalline Cu sample in the temperature range from 4 to 296 K.

FIG. 3 shows the typical true stress-strain curve of as-deposited Cu at room temperature, for comparison, the tensile curve of coarse-grained Cu is also included. The yield strength of as-deposited Cu is 900±10 MPa and elongation is 13.5% at the tensile rate of 6×$10^{-3}$ $s^{-1}$. FIG. 4 displays the measured temperature (4-296K) dependence of the electrical resistivity for the as-deposited Cu sample with nano-scale twins in comparison with the coarse grained one. The electrical resistivity for the Cu with nano-scale twins is (1.75±0.02)×$10^{-8}$ Ω·m at room temperature, in comparison with (1.67±0.02)×$10^{-8}$ Ω·m for the coarse-grained Cu.

EXAMPLE 2

The differences from Example 1 are as follows.

1. The Cu materials with nano-twin lamellae structures were prepared by electrodeposition. The electrolyte was composed of electron purity grade $CuSO_4$ solution with distilled water and the acidity was pH=0.5. A pure Cu sheet (purity >99.99%) was used as anode and Fe sheet with a Ni—P amorphous surface layer was used as the cathode, the area ratio of anode to cathode was about 30:1.
2. The bath additive was a combination of 0.02 mL/L gelatine aqueous solution (concentration 5%) and 0.2 mL/L high-purity NaCl aqueous solution (concentration 5%). Electrolysis processing parameters were as follows: pulsed current density is 80 A/$cm^2$, on-time ($t_{on}$) is 0.05 s, off-time ($t_{off}$) is 3 s, the polar distance is 50 mm, bath temperature is 15° C.

Under the above condition, a Cu material with high-purity nano-scale twin lamellar structure can be achieved likewise. TEM observation showed that such a nano-scale twin Cu has a similar microstructure as the former one: the structure is also composed of roughly equiaxed submicron-sized grains, in which are high-density of nano-twin lamellar structures with different orientations. However, the average twin spacing is larger, being about 30 nm. The dislocation density is low too. The tensile yield strength of the this Cu is 810 MPa, and electrical resistivity is (1.927±0.02)×$10^{-8}$ Ω·m at room temperature.

EXAMPLE 3

The differences from Example 1 are as follows.

1. The Cu materials with nano-twin lamellae structures were prepared by electrodeposition. The electrolyte were composed of electron purity grade $CuSO_4$ solution with distilled water and the acidity is PH=1.5. A pure Cu sheet (purity >99.99%) was used as anode and low carbon steel sheet with a Ni—P amorphous surface layer as cathode, the area ratio of anode to cathode was 40:1.
2. The bath additive was a combination of 0.15 mL/L gelatine aqueous solution (concentration 25%) and 1.0 mL/L high-purity NaCl aqueous solution (concentration 25%). Electrolysis processing parameters were as follows: the pulsed current density is 40 A/$cm^2$, on-time ($t_{on}$) is 0.01 s, off-time ($t_{off}$) is 1 s, the polar distance is 150 mm, bath temperature is 25° C.

Under the above condition, a Cu material with high-purity and high-density growth-in twins can be produced likewise. TEM observation showed that the present nano-twin Cu is also composed of roughly equiaxed submicron-sized grains, containing high-density growth twins with different orientations, the average thickness of lamellar twins is about 43 nm, and the dislocation density is very low. The tensile yield strength is 650 MPa, and electrical resistivity is (2.151±0.02)×$10^{-8}$ Ω·m at room temperature.

COMPARATIVE EXAMPLE 1

Conventional as-annealed coarse-grained Cu usually has a tensile yield strength ($\sigma_y$) less than 35 MPa and an ultimate tensile strength ($\sigma_{uts}$) less than 200 MPa, with an elongation-to-failure of less that 60% at room temperature. The tensile yield strength and ultimate strength for the cold-rolled Cu are usually increased to about 250 MPa and 290 MPa, respectively, with an elongation-to-failure of about 8%. Therefore, the tensile strength of conventional coarse-grained Cu (either as-annealed or cold-rolled) is usually lower than 250 MPa.

COMPARATIVE EXAMPLE 2

American scientists R. Suryanarayana et al. had produced nanocrystalline Cu powders by mechanically alloying. After purified, the powders were pressed to a bulk nanocrystalline Cu specimen (grain size of 26 nm), and the measured tensile yield strength for this sample is about 400 MPa.

COMPARATIVE EXAMPLE 3

The nanocrystalline Cu materials with average grain sizes between 22 nm and 110 nm were made by means of the inert-gas condensation (IGC) and in-situ compaction technique (pressure 1-5 GPa) in the high vacuum ($10^{-5}$-$10^{-6}$ Pa) as reported by American scientists J. Weertman et al. The density of the sample was about 96% of the theoretical one and the microstrain was higher. Room-temperature constant tensile testing results showed that the nanocrystalline Cu exhibited a higher strength than coarse-grained Cu, the tensile yield strength and the failure strength are about 300-360 MPa and 415-480 MPa, respectively. Investigations also show that the strength of a material is closely related to not only to its average grain size, but also to its preparation history: the sample with a smaller grain size usually shows a higher strength, whereas the sample with larger grains shows a lower strength, and the plasticity decreases with decreasing grain sizes. When the grain size decreases down to 22 nm, the yield strength reaches to a maximum value of 360 MPa, then decreases with further increasing grain sizes. One of the big differences between the Cu samples prepared by IGC and electrodeposition is that the electrical resistivity of the former sample was pretty high.

COMPARATIVE EXAMPLE 4

American scientists J. Weertman et al. prepared a nanocrystalline Cu sample with average grain size of 30 nm which was solidified by, the inert-gas condensated powers (at a pressure of 1.4 GPa). The density of a sample was 99% of the theoretical one. The tensile properties of microsamples (the whole length of the samples is 3 mm, section-area is 200 μm×200 μm) showed that the yield strength reached to 535 MPa. However, it is clear that the obtained mechanical properties from macrosamples can give us a reliable overall understanding on the mechanical behavior and its microstructures.

COMPARATIVE EXAMPLE 5

In China, L. Lu and K. Lu et al. prepared the bulk nanoscale Cu with 30 nm in grain size by DC electrodeposition. The experiment indicated that as-deposited nanocrystalline Cu has small-angle grain boundaries (different from the large-angle grain boundaries of conventional nanocrystalline materials), the room-temperature yield strength is 119 MPa and elongation is 30%. If the as-deposited nanocrystalline Cu sample was rolled at room temperature, the average grain size of the sample remains unchanged, whereas the misorientation between the nanocrystallites and the dislocation density in the sample increased. The yield strength of the as-rolled nanocrystalline Cu with the same average grain size but different microstructures extremely increases to 425 MPa, however the elongation decreases to only 1.4%.

COMPARATIVE EXAMPLE 6

The submicron-sized pure Cu without porosity was obtained by severe plastic deformation, as reported by Russian scientists R. Z. Valiev et al. The average grain size of the Cu sample was 210 nm, but residual stress in the sample was high. At room temperature, the tensile strength was 500 MPa, elongation was about 5%. The room temperature electrical resistance of the sample was $2.24\times10^{-8}$ Ω·m, corresponding to 70% IACS.

What is claimed:

1. A nano-twin copper material with ultrahigh strength and high electrical conductivity comprising roughly equiaxed submicron-sized grains, inside each grain, there twin lamellae with different orientations and high density; and the twin lamellae with the same orientations are inter-parallel; the thickness of the twin lamellae range from several nanometers to 100 nm; and the lengths from 100-500 nm.

2. The nano-twin copper material with ultrahigh strength and high electrical conductivity according to claim 1, wherein the nano-twin copper material has, at a temperature of 293 K, a density of 8.93±0.03 g/cm$^3$, a purity of 99.997±0.02 at %, a yield strength of 900±10 MPa, an elongation of 13.5±0.5%, a tensile strain rate of $6\times10^{-3}$/s, an electrical resistivity of $(1.75\pm0.02)\times10^{-8}$ Ω·m, and a temperature coefficient of resistivity of $6.78\times10^{-11}$ K$^{-1}$.

3. The nano-twin copper material with ultrahigh strength and high electrical conductivity according to claim 1, wherein the size of the grains range from 300-1000 nm.

4. A method for producing a nano-twin copper material with ultrahigh strength and high electrical conductivity according to claim 1, which comprises performing electrodeposition using an electron purity grade $CuSO_4$ solution having a pH of 0.5-1.5 and ion-exchanged water or distilled water as an electrolyte, 99.99% pure Cu sheet as an anode, an iron sheet or a low carbon steel sheet with surface plated by a Ni—P amorphous layer as a cathode; and an additive comprising 0.02-0.2 mL/L gelatine aqueous solution with concentration of 5-25% and 0.2-1.0 mL/L high-purity NaCl aqueous solution with concentration of 5-25%;

with a pulse current density of 40~100 A/cm$^2$; an on-time ($t_{on}$) of 0.01~0.05 s and an off-time ($t_{off}$) of 1~3 s; a distance of 50~100 mm between the anode and the cathode, and the anode to cathode area ratio of 30~50:1; and electromagnetically stirring at a temperature of 15~30° C.

* * * * *